US011802752B2

(12) United States Patent
Hamilton et al.

(10) Patent No.: US 11,802,752 B2
(45) Date of Patent: Oct. 31, 2023

(54) VIEWING OPTIC WITH WIND DIRECTION CAPTURE AND METHOD OF USING THE SAME

(71) Applicant: Sheltered Wings, Inc., Barneveld, WI (US)

(72) Inventors: David Hamilton, Barneveld, WI (US); Richard E. Campbell, Barneveld, WI (US); Scott Parks, Barneveld, WI (US); Paul Neess, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 0 days.

(21) Appl. No.: 17/314,238

(22) Filed: May 7, 2021

(65) Prior Publication Data

US 2021/0262761 A1 Aug. 26, 2021

Related U.S. Application Data

(63) Continuation of application No. 16/384,515, filed on Apr. 15, 2019, now Pat. No. 11,002,514.

(60) Provisional application No. 62/657,450, filed on Apr. 13, 2018.

(51) Int. Cl.

| | |
|---|---|
| ***F41G 3/08*** | (2006.01) |
| ***F41G 3/02*** | (2006.01) |
| ***F41G 3/06*** | (2006.01) |

(52) U.S. Cl.

CPC ..... *F41G 3/08* (2013.01); *F41G 3/02* (2013.01); *F41G 3/06* (2013.01)

(58) Field of Classification Search

None

See application file for complete search history.

(56) References Cited

U.S. PATENT DOCUMENTS

| | | | |
|---|---|---|---|
| 3,475,821 | A | 11/1969 | Huddleston |
| 3,609,299 | A | 9/1971 | Wright |
| 3,744,133 | A | 7/1973 | Fukushima et al. |
| 5,291,262 | A | 3/1994 | Dunne |
| 5,574,552 | A | 11/1996 | Dunne |
| 5,914,775 | A | 6/1999 | Hargrove et al. |
| 5,920,995 | A | 7/1999 | Sammut |
| 6,032,374 | A | 3/2000 | Sammut |
| 6,327,806 | B1 | 12/2001 | Paige |
| 6,405,107 | B1 | 6/2002 | Derman |

(Continued)

FOREIGN PATENT DOCUMENTS

WO 2016118665 A1 7/2016

OTHER PUBLICATIONS

International Search Report and Written Opinion for PCT/US14/52161 dated Dec. 2, 2014, 7 pages.

(Continued)

*Primary Examiner* — Kristy A Haupt

(74) *Attorney, Agent, or Firm* — Husch Blackwell LLP

(57) ABSTRACT

The disclosure relates to a viewing optic. In one embodiment, the viewing optic has a direction sensor to capture the direction of wind. In one embodiment, the viewing optic has a ranging system to determine the distance to a target. In one embodiment, the viewing optic has a processor with a ballistics program that can use the distance and the wind direction to determine a ballistics trajectory. Further, the disclosure relates to methods for capturing wind direction.

20 Claims, 3 Drawing Sheets

(56) References Cited

U.S. PATENT DOCUMENTS

| | | | | |
|---|---|---|---|---|
| 6,453,595 | B1 | 9/2002 | Sammut | |
| 6,516,699 | B2 | 2/2003 | Sammut et al. | |
| 6,681,512 | B2 | 1/2004 | Sammut | |
| 6,873,406 | B1 | 3/2005 | Hines et al. | |
| 6,933,859 | B2 | 8/2005 | Hurt et al. | |
| 7,516,571 | B2 | 4/2009 | Scrogin et al. | |
| 7,603,804 | B2 | 10/2009 | Zaderey et al. | |
| 7,654,029 | B2 | 2/2010 | Peters et al. | |
| 7,658,031 | B2 | 2/2010 | Cross et al. | |
| 7,690,145 | B2 | 4/2010 | Peters et al. | |
| 7,746,343 | B1 | 6/2010 | Charaniya et al. | |
| 7,832,137 | B2 | 11/2010 | Sammut | |
| 7,856,750 | B2 | 12/2010 | Sammut et al. | |
| 7,937,878 | B2 | 5/2011 | Sammut et al. | |
| 8,046,951 | B2 | 11/2011 | Peters et al. | |
| 8,072,581 | B1 | 12/2011 | Breiholz | |
| 8,109,029 | B1 | 2/2012 | Sammut et al. | |
| 8,172,139 | B1 | 5/2012 | McDonald et al. | |
| 8,468,930 | B1 | 6/2013 | Bell | |
| 8,529,380 | B1 | 9/2013 | Hubenthal et al. | |
| 8,650,220 | B2 | 2/2014 | Rohlf et al. | |
| 8,713,843 | B2 | 5/2014 | Windauer | |
| 9,062,961 | B2 | 6/2015 | Chen et al. | |
| 9,151,570 | B2 | 10/2015 | Plaster | |
| 9,310,165 | B2 | 4/2016 | Bell et al. | |
| 11,002,514 | B2 * | 5/2021 | Hamilton | F41G 3/065 |
| 2005/0021282 | A1 | 1/2005 | Sammut et al. | |
| 2005/0268521 | A1 | 12/2005 | Cox et al. | |
| 2006/0214935 | A1 | 9/2006 | Boyd et al. | |
| 2006/0273932 | A1 | 12/2006 | Wise | |
| 2007/0103671 | A1 | 5/2007 | Ash | |
| 2008/0202011 | A1 | 8/2008 | Shepherd | |
| 2008/0218612 | A1 | 9/2008 | Border et al. | |
| 2009/0266892 | A1 | 10/2009 | Windauer et al. | |
| 2011/0168777 | A1 | 7/2011 | Bay | |
| 2011/0297744 | A1 | 12/2011 | Schneider et al. | |
| 2012/0186131 | A1 | 7/2012 | Windauer | |
| 2013/0014421 | A1 | 1/2013 | Sammut et al. | |
| 2013/0206836 | A1 | 8/2013 | Paterson et al. | |
| 2014/0115942 | A1 | 5/2014 | Plaster | |
| 2015/0055119 | A1 * | 2/2015 | Hamilton | F41G 1/473 356/4.01 |
| 2016/0084617 | A1 | 3/2016 | Lyren | |
| 2016/0091282 | A1 | 3/2016 | Baker et al. | |
| 2017/0176143 | A1 | 6/2017 | Zhang et al. | |

OTHER PUBLICATIONS

International Preliminary Report on Patentability for PCT/US2019/027535 dated Oct. 13, 2020, 7 pages.

International Search Report and Written Opinion for PCT/US2019/027535 dated Jul. 2, 2019, 8 pages.

Draft Petition for Post Grant Review of U.S. Pat. No. 11,002,514 received from Gunwerks LLC.

Draft Declaration of John H. Lupher in Support of Petition for Post Grant Review of U.S. Pat. No. 11,002,514 received from Gunwerks LLC.

* cited by examiner

VIEWING OPTIC WITH WIND DIRECTION CAPTURE AND METHOD OF USING THE SAME

CROSS REFERENCE TO RELATED APPLICATIONS

This application is a continuation patent application of U.S. patent application Ser. No. 16/384,515 filed Apr. 15, 2019, which claims priority to and is a non-provisional application of Provisional Application No. 62/657,450 filed Apr. 13, 2018, which is incorporated herein by reference in its entirety.

FIELD

The disclosure relates to viewing optics, and more particularly to viewing optics having an integrated direction sensor with wind direction capture capability. In another embodiment, the disclosure relates to a method for utilizing a viewing optic with an integrated direction sensor with wind direction capture capability.

BACKGROUND

Previous viewing optics, such as laser rangefinders, which include integrated ballistics calculators, require a user to either manually input wind direction or have an external device connected to the viewing optic. Manually inputting the wind direction into a viewing optic is very cumbersome and highly inaccurate. The speed and direction of the wind are very important factors in calculating a ballistics solution. Just as important is the timeliness of inputting this information before wind direction changes or the target moves.

Generally, wind direction is observed and/or measured on a first device, then manually inputted into the viewing optic. For example, consider a hunter trying to shoot a deer at 750 yards. The hunter gets a ballistic solution based on 8-mph winds at 75° relative to the hunter, and this data was previously inputted. Just prior to pulling the trigger, the wind changes direction and is now 130° relative to the hunter. If the hunter had to manually input wind direction again by cycling through multiple menus and then updating the wind information, there is a good chance the hunter will not be able to take his/her shot.

Wind direction is only one factor used by ballistics calculators to determine a bullet's trajectory. Additional environmental factors, such as barometric pressure, humidity, and temperature also affect a bullet's trajectory. In many instances, a user must carry multiple instruments in order to capture the environmental data desired to be inputted into a ballistics calculator to generate a more complete ballistic trajectory.

The same scenario(s) can also be applied to competition shooting, in which each shooter s timed on his/her shots and must make quick adjustments. Prior to taking a shot, the shooter quickly enters all environmental parameters. Typically, wind direction and speed are the only parameters that are not directly inputted into the ballistics calculator. Therefore, the shooter must quickly input them and set up to shoot the target. If the wind changes direction or speed just prior to taking the shot, the shooter will need to input new wind data into the ballistics calculator onboard the viewing optic.

The following is an example of the steps required to input a 10-mph wind speed coming from a direction of 320° as referenced from true North:

(1) Press and hold a specified button for a pre-programmed amount of time to have the necessary menu displayed;
(2) Press a specified button to navigate through the menu options to a further menu which allows the user to modify wind direction;
(3) Press a specified button to change wind direction, e.g., using standard clock hour values from 1:00 to 12:00 with each hour representing a 30° segment of a 360° circle;
(4) Press a specified button to navigate to the menu that allows you to modify the wind speed;
(5) Press a specified button to input a 10-mph wind speed, e.g., by pressing a specified increase or decrease button until the value displayed is 10-mph;
(6) Press and hold a specified button for a pre-programmed amount of time to exit the menu; and
(7) Press a specified button to take a range.

As outlined above, viewing optics with onboard ballistic calculators require the user to navigate multiple menus to input the wind direction and speed and/or use multiple instruments to obtain the information necessary to complete a ballistic calculation. Thus, a need still exists for a viewing optic, such a binocular or monocular, that can quickly obtain wind direction and/or eliminate the need for a user to carry multiple instruments.

SUMMARY

In one embodiment, the disclosure provides a viewing optic. In one embodiment, the viewing optic comprises a direction sensor to determine the direction from which wind originates. In another embodiment, the viewing optic further comprises a ranging system to determine the distance from a user to a target. In another embodiment, the viewing optic further comprises a processor in communication with ranging system and the direction sensor.

In another embodiment, the disclosure relates to a direction sensor for determining the direction to a target when a ranging system is activated. In one embodiment, the disclosure relates to a single direction sensor for determining the direction from which wind originates, and direction of a target when a ranging system is activated. In one embodiment, only one direction sensor is needed to determine the direction from which the wind originates and the direction of a target.

In one embodiment, the viewing optic comprises a direction sensor, a ballistics calculator in communication with the direction sensor, and at least one button operatively connected to the direction sensor. In one embodiment, the direction sensor is a compass that captures/determines the direction from which the wind originates. In one embodiment, the direction sensor also captures/determines the direction of a target when a ranging system is activated.

In one embodiment, the disclosure relates to a viewing optic comprising: a body, the body including a display; a ranging system for measuring a distance to a target and mounted within the body; a direction sensor mounted within the body for determining direction of wind and direction of a target when a ranging system is activated; and a processor mounted within the body and capable of controlling information for showing on the display. In one embodiment, the processor is in communication with the direction sensor and the ranging system. In one embodiment, the processor has a ballistics computer program. In one embodiment, the ballistics computer program uses the direction of the wind, the direction to a target, and the distance to a target to calculate a ballistic trajectory.

In one embodiment, the disclosure relates to a rangefinder. In one embodiment, the rangefinder comprises a ranging system to determine the distance from a user to a target and a direction sensor to determine the direction from which wind originates. In another embodiment, the rangefinder further comprises a processor in communication with ranging system and the wind direction sensor. In one embodiment, the direction sensor also captures/determines the direction of a target when a ranging system is activated.

In one embodiment, the processor of the rangefinder is in communication with a second device. In one embodiment, the second device includes but is not limited to a monocular, a binocular, a viewing optic, a riflescope, a computer monitor, a mobile device, or any other device having a screen for viewing. In one embodiment, the process of the rangefinder can communicate wirelessly with the second device.

In one embodiment, the rangefinder is directly coupled to the second device. In one embodiment, the rangefinder is indirectly coupled to the second device.

In one embodiment, the disclosure relates to a rangefinder comprising: a body, a ranging system for measuring a distance to a target and mounted within the body; a direction sensor mounted within the body for determining direction of wind and direction to a target when the ranging system is activated; and a processor mounted within the body and capable of communicating information from the direction sensor to a second device. In one embodiment, the second device has a display for showing the relevant information including but not limited to direction of the wind and a ballistics trajectory.

In one embodiment, the disclosure relates to a weapons mounted laser rangefinder.

In one embodiment, the disclosure relates to a rangefinder comprising: a body, the body including a display; a ranging system for measuring the distance to a target and mounted within the body, a direction sensor for determining direction of wind and mounted within the body; and a processor mounted within the body and in communication with the ranging system and the direction sensor, the processor having a ballistics computer program that uses the distance from the ranging system and the wind direction from the direction sensor to determine a ballistic trajectory that is communicated to the display. In one embodiment, the direction sensor also captures/determines the direction of the target when a ranging system is activated. In one embodiment, the ballistics computer program also uses the direction of the target to calculate a ballistics trajectory.

In one embodiment, the disclosure relates to a rangefinder comprising: a body; a ranging system for measuring the distance to a target and mounted within the body; a direction sensor mounted within the body for determining direction of wind and direction of the target; a processor mounted within the body and in communication with the ranging system and the direction sensor, the processor having a ballistics computer program that uses the distance from the ranging system, the wind direction and direction of the target from the direction sensor to determine a ballistic trajectory.

In one embodiment, the processor of the viewing optic or the rangefinder comprises a ballistics computer program for analyzing information, including but not limited to range and wind direction, to accurately aim a projectile at a target. In one embodiment, the ballistics computer program using numerous factors including but not limited to range signal, wind direction, wind speed and additional ballistics information, determines a corrected aiming point for a projectile.

In another embodiment, the disclosure provides a method for determining wind direction. The method comprises accessing a wind direction capture mode of a viewing optic; pointing the viewing optic in a direction corresponding to a direction that the wind originates; capturing the wind direction by activating the direction sensor. In one embodiment, the method further includes inputting wind speed. In one embodiment, inputting wind speed comprises pushing/pressing/sliding one or more control devices, such as a button.

In another embodiment, the disclosure provides a method for determining a ballistic trajectory comprising: accessing a wind direction capture mode of a viewing optic, the viewing optic having a body, a direction sensor for determining direction from which the wind originates and mounted within the body, a processor mounted within the body and in communication with the direction sensor, and having a ballistics computer program; pointing the viewing optic in a direction corresponding to a direction that the wind originates; capturing the wind direction by activating the direction sensor; communicating the wind direction from the direction sensor to the ballistics computer program of the processor, and using the ballistics computer program of the processor to determine a ballistic trajectory.

In another embodiment, the disclosure provides a method for determining a ballistic trajectory comprising: accessing a wind direction capture mode of a viewing optic, the viewing optic having a body, a ranging system for determining distance to a target, a direction sensor mounted within the body for determining direction from which the wind originates and direction of a target upon activation of the ranging system, a processor mounted within the body and in communication with the direction sensor, and having a ballistics computer program; pointing the viewing optic in a direction corresponding to a direction that the wind originates; capturing the wind direction by activating the direction sensor and communicating the wind direction to the processor; determining distance to a target by activating the range finding system and simultaneously determining direction of a target with the direction sensor, communicating the direction of the target from the direction sensor and the distance from the ranging system to the ballistics computer program of the processor, and using the ballistics computer program of the processor to determine a ballistic trajectory.

Other embodiments will be evident from a consideration of the drawings taken together with the detailed description provided herein.

DETAILED DESCRIPTION

Figure 1:
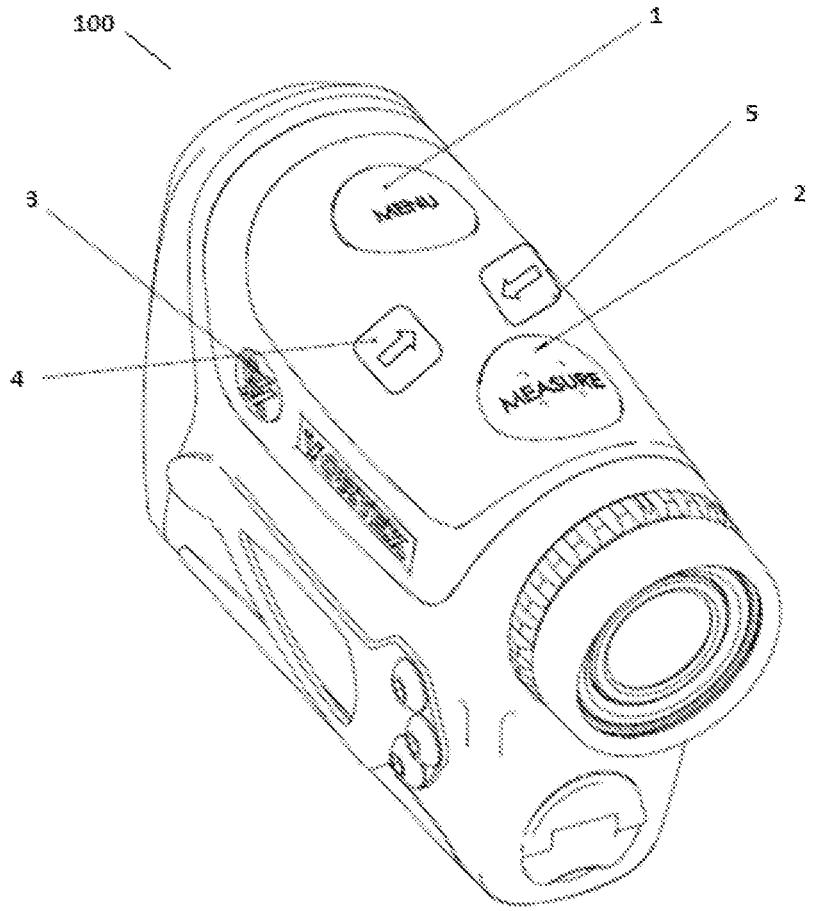
FIG. 1 is an isometric view of an exemplary viewing optic, which is a rangefinding monocular, incorporating wind direction capture functionality in accordance with embodiments of the disclosure.

In one embodiment, the disclosure relates to viewing optics, and more particularly to viewing optics having wind direction capture functionality. In another embodiment, the disclosure relates to rangefinders, and more particularly to rangefinders having wind direction capture functionality. Certain preferred and illustrative embodiments of the disclosure are described below and with reference to the accompanying drawings. The disclosure is not limited to these embodiments; rather, these embodiments are provided so that the disclosure will be thorough and complete and will fully convey the scope of the disclosure to those skilled in the art.

It will be appreciated by those skilled in the art that the set of features and/or capabilities may be readily adapted within the context of a standalone viewing optic, such as a weapons sight, front-mount or rear-mount clip-on weapons sight, and other permutations of filed deployed optical weapons sights. Further, it will be appreciated by those skilled in the art that various combinations of features and capabilities may be incorporated into add-on modules for retrofitting existing fixed or variable viewing optics of any variety.

Definitions

Like numbers refer to like elements throughout. It will be understood that, although the terms first, second, etc., may be used herein to describe various elements, components, regions, and/or sections, these elements, components, regions and/or sections should not be limited by these terms. These terms are used only to distinguish one element, component, region and/or section from another element, component, region and/or section. Thus, a first element, component, region or section could be termed a second element, component, region or section without departing from the disclosure.

The numerical ranges in this disclosure are approximate, and thus may include values outside of the range unless otherwise indicated. Numerical ranges include all values from and including the lower and the upper values (unless specifically stated otherwise), in increments of one unit, provided that there is a separation of at least two units between any lower value and any higher value. As an example, if a compositional, physical or other property, such as, for example, distance, speed, velocity, etc., is from 10 to 100, it is intended that all individual values, such as 10, 11, 12, etc., and sub ranges, such as 10 to 44, 55 to 70, 97 to 100, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, distances from a user of a device to a target.

Spatial terms, such as "beneath," "below," "lower," "above," "upper," and the like, may be used herein for ease of description to describe one element's or feature's relationship to another element(s) or feature(s) as illustrated in the figures. It will be understood that the spatially relative terms are intended to encompass different orientations of device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the term "and/or" includes any and all combinations of one or more of the associated listed items. For example, when used in a phrase such as "A and/or B," the phrase "and/or" is intended to include both A and B; A or B; A (alone); and B (alone). Likewise, the term "and/or" as used in a phrase such as "A, B and/or C" is intended to encompass each of the following embodiments" A, B and C; A, B, or C; A or C; A or B; B or C; A and C; A and B; B and C; A (alone); B (alone); and C (alone).

As used herein, the term "anemometer" refers to an instrument for measuring the force, velocity and, in some embodiments, direction, of wind. Anemometers include, but are not limited to, impeller-type anemometers, ultrasonic anemometers, hot wire anemometers, pressure tube anemometers, cup anemometers, and laser Doppler anemometers.

As used herein, the term "ballistics" refers to the field of mechanics that deals with the launching, flight, behavior and effects of projectiles, especially bullets, unguided bombs, rockets, or the like, as well as the science or art of designing and accelerating projectiles so as to achieve a desired performance.

As used herein, the term "ballistics calculator" refers to a computer program that provides the user/shooter/spotter a solution for the trajectory of a projectile. In one embodiment, a ballistics calculator is used to produce a corrected aim point for the projectile. As used herein, the terms "ballistics calculator" and "ballistics computer program" are used interchangeably.

As used herein, the term "barometric pressure sensor" refers to a device, instrument or assembly that measures the pressure exerted by the atmosphere and changes in such pressure.

As used herein, the term "bullet" refers to a projectile for filing from a firearm, such as a rifle or revolver, typically made of metal, cylindrical and pointed. A bullet may sometimes contain an explosive.

As used herein, the terms "computer memory" and "computer memory device" refer to any storage media readable by a computer processor. Examples of computer memory include, but are not limited to, RAM, ROM, computer chips, digital video disc (DVDs), compact discs (CDs), hard disk drives (HDD), and magnetic tape.

As used herein, the term "computer readable medium" refers to any device or system for storing and providing information (e.g., data and instructions) to a computer processor. Examples of computer readable media include, but are not limited to, DVDs, CDs, hard disk drives, memory chip, magnetic tape and servers for streaming media over networks.

As used herein, the terms "processor" and "central processing unit" or "CPU" are used interchangeably and refer to a device that is able to read a program from a computer memory (e.g., ROM or other computer memory) and perform a set of steps according to the program.

As used herein, the term "direction sensor" refers to a device, instrument or assembly used for orientation of a device to which the direction sensor is connected or integrated in relation to cardinal directions. In an embodiment, a direction sensor is a compass.

As used herein, the term "firearm" refers to a portable gun, being a barreled weapon that launches one or more projectiles often driven by the action of an explosive force.

Exemplary firearms include, but are not limited to, handguns, long guns, rifles, shotguns, carbines, automatic weapons, semi-automatic weapons, machine guns, sub-machine guns, automatic rifles, and assault rifles.

As used herein, the term "humidity sensor" refers to a device, instrument or assembly that senses, measures and, in some embodiments, reports, the relative humidity in the environment to which the device, instrument or assembly is exposed, e.g., the air.

As used herein, the term "laser rangefinder" refers to a device or assembly that uses a laser beam to determine the distance to a target object.

As used herein, the terms "on," "connected to" and "coupled to," when used in reference to two components, elements or layers, mean that the two components, elements or layers are, directly or indirectly, coupled to one another either physically or operably, and one or more intervening components, elements or layers may be present. In contrast, the terms "directly on," "directly connected to" and "directly coupled to" mean that the two components, elements or layers are coupled to one another either physically or operatively with no intervening components, elements or layers.

As used herein, the term "temperature sensor" refers to a device, instrument or assembly that senses, measures and, in some embodiments, reports, the temperature of the environment to which the temperature sensor is exposed, e.g., the air.

As used herein, the term "user" refers to either the operator making the shot or an individual observing the shot in collaboration with the operator making the shot.

As used herein, the term "viewing optic" refers to an apparatus or assembly used by a user, a shooter or a spotter to select, identify and/or monitor a target. A viewing optic may rely on visual observation of the target or, for example, on infrared (IR), ultraviolet (UV), radar, thermal, microwave, magnetic imaging, radiation including X-ray, gamma ray, isotope and particle radiation, night vision, vibrational receptors including ultra-sound, sound pulse, sonar, seismic vibrations, magnetic resonance, gravitational receptors, broadcast frequencies including radio wave, television and cellular receptors, or other image of the target. The image of the target presented to a user/shooter/spotter by a viewing optic may be unaltered, or it may be enhanced, for example, by magnification, amplification, subtraction, superimposition, filtration, stabilization, template matching, or other means. The target selected, identified and/or monitored by a viewing optic may be within the line of sight of the shooter or tangential to the sight of the shooter. In other embodiments, the shooter's line of sight may be obstructed while the viewing optic presents a focused image of the target. The image of the target acquired by the viewing optic may, for example, be analog or digital, and shared, stored archived or transmitted within a network of one or more shooters and spotters by, for example, video, physical cable or wire, IR, radio wave, cellular connections, laser pulse, optical 802.11b or other wireless transmission using, for example, protocols such as html. SML, SOAP, X.25, SNA, etc., Bluetooth™, Serial, USB or other suitable image distribution method.

The apparatus and methods disclosed herein relate to a viewing optic. In one embodiment, the viewing optic has a body, and a direction sensor for determining direction of wind mounted within the body. In one embodiment, the direction sensor is coupled to the viewing optic. In one embodiment, the direction sensor is directly or indirectly coupled to the viewing optic. In one embodiment, the direction sensor is integrated into the viewing optic. In one embodiment, the direction sensor is a compass having a 3-axis accelerometer, and a 3-axis magnetometer.

In one embodiment, the apparatus and methods disclosed herein relate to a viewing optic with rangefinding capabilities. In one embodiment, the viewing optic disclosed herein can determine one or more variables that affect the trajectory of a projectile. In one embodiment, the viewing optic disclosed herein can determine range to target information and can automatically determine barometric pressure, ambient temperature, and relative humidity and provides a convenient method for determining wind direction.

In one embodiment, the viewing optic has a range finding system for determining range to target information; a wind direction sensor for determining wind direction, and a processor in communication with the range finding system and the wind direction sensor and having a ballistics computer program, wherein the ballistics computer program uses the range and wind direction to determine trajectory of a projectile. In one embodiment, the ballistics computer program can calculate a corrected aim point.

FIG. 1 is an isometric view of an exemplary viewing optic 100, which is a rangefinding monocular, incorporating wind direction capture functionality in accordance with embodiments of the disclosure. In one embodiment, the viewing optic 100 has a body, the body having a direction sensor that can determine wind direction without requiring a user to input a variable into the system. The direction sensor can automatically determine the direction of wind. In one embodiment, the viewing optic 100 uses a direction sensor to determine the direction of the wind based on the location of the viewing optic 100. In one embodiment, the viewing optic 100 can have a display.

In the embodiment shown, the viewing optic 100 includes a menu button 1, a measure button 2, a wind capture button 3, and first and second selection buttons 4, 5, respectively. The viewing optic 100 further includes onboard rangefinder functionality. The menu button 1 allows a user to access the onboard rangefinder functionality and, for example, enter and/or exit various modes. The measure button 2 is used to fire the laser in order to obtain a range to an intended target. The wind capture button 3 is used to enter and/or exit a mode, which permits the capture of the wind direction and/or capture the wind speed. The first and second selection buttons 4, 5 allow users to navigate through menus and/or, when in wind capture mode, to increase and/or decrease, wind speed. In one embodiment, the first and second selection buttons 4, 5 permit a user to increase and/or decrease wind speed regardless of the mode of the onboard rangefinder.

In one embodiment, upon activation of measure button 2, the direction sensor can determine the direction to a target.

In one embodiment, the types of variables and features that may be adjusted in menu mode include, but are not limited to, the profile, wind speed, ballistic coefficient, muzzle velocity, drag standard, sight height and zero range. In some embodiments, the parameters of the viewing optic that can be adjusted or for which data can be entered could be classified as menu options and menu selections. For example, menu option could be the parameter or variable itself, such as range units, or ballistic coefficient as examples. Menu selection would then be the selected value or data input for that parameter, and could be provided by scrolling or clicking through options that could be selected, or could even be entered manually into the viewing optic itself or through data input from another device. In one embodiment, the menu option allows for the selection of range units, and the user can choose from menu selections for yards or meters.

Figure 2:
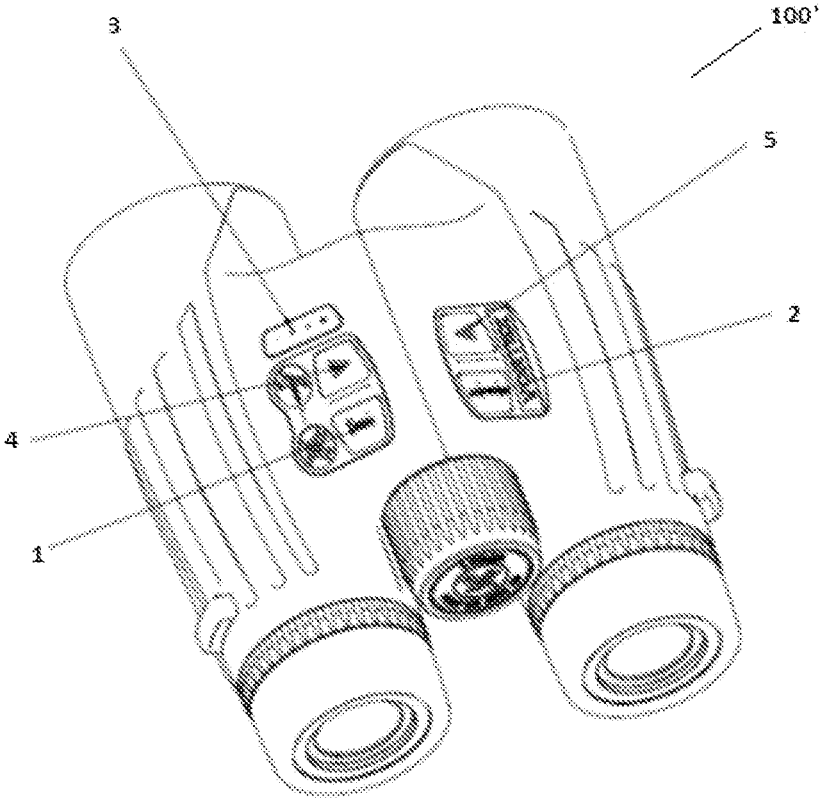
FIG. 2 is an isometric view of an exemplary viewing optic, which is a rangefinding binocular, incorporating wind direction capture functionality in accordance with embodiments of the disclosure.

FIG. 2 is an isometric view of an exemplary viewing optic 100,' which is a rangefinding binocular, incorporating wind direction capture functionality in accordance with embodiments of the disclosure. Like the rangefinding monocular 100, the binocular 100' also has an onboard ballistics calculator (such as described above), a menu button 1, a measure button 2, a wind capture button 3, and first and second selection buttons 4, 5, respectively. The menu button 1 allows a user to access the onboard rangefinder functionality and, for example, enter and/or exit various modes. The measure button 2 is used to fire the laser in order to obtain a range to an intended target. The wind capture button 3 is used to enter and/or exit a mode, which permits the capture of the wind direction and/or capture the wind speed. The first and second selection buttons 4, 5 allow users to navigate through menus and/or, when in wind capture mode, to increase and/or decrease, wind speed. In one embodiment, the first and second selection buttons 4, 5 permit a user to increase and/or decrease wind speed regardless of the mode of the onboard rangefinder.

In an embodiment, a viewing optic 100/100' further includes an integrated direction sensor, such as a compass (not shown). The direction sensor may be independent from the ballistics calculator or, in further embodiments, in communication (either directly or indirectly) with the ballistics calculator. In the particular embodiments shown, the direction sensor is operatively coupled to the wind capture button 3. Activation of the wind capture button 3 causes the wind direction to be measured and/or captured.

In one embodiment, the direction sensor is a compass having a 6-axis integrated linear accelerometer and magnetometer. In one embodiment, the direction sensor is a compass having a 3-axis accelerometer and a 3-axis magnetometer.

In one embodiment, upon activation of the range measure button 2, the direction sensor can also determine the direction to the target. In one embodiment, the direction sensor determines the direction to the target when the ranging system is activated. In one embodiment, the direction of the target is computed against the captured wind direction.

In one embodiment, the direction sensor determines the direction to the target in relation to the direction of the captured wind, which can be stored in one or more memory devices.

In an embodiment, a viewing optic 100/100' further includes a ranging system (not shown). A standard ranging system uses a laser beam to determine the distance to an object or to a target, and operates by sending a laser pulse towards target and measuring the time taken by the pulse to be reflected off the target and returned. In general terms, a laser pulse is emitted from a transmitter, such as a pulse laser diode. Part of the beam emitted travels through a beam splitter, and part is reflected to detector. The emitted laser pulse travels through a transmission lens to target, which reflects a portion of the laser pulse back through receiving lens and subsequently through receiver to a micro-controller unit, which calculates the distance to target using well, known mathematical principles. Ranging system could also be a more complex system with additional or alternative components, including gain control components, charging capacitors, and analog to digital converters by way of example.

In an embodiment, the viewing optic 100/100' further includes at least one sensor of an anemometer, a barometric pressure sensor, a humidity sensor, and a temperature sensor. In a preferred embodiment, the viewing optic 100/100' includes at least one, at least two, at least three, or all four of an anemometer, a barometric pressure sensor, a humidity sensor, and a temperature sensor. These sensors are operatively coupled to the ballistic calculator such that the ballistics calculator can utilize the data captured by the one or more sensors in determining a bullet trajectory.

In a further embodiment, the one or more sensors are operatively coupled to a memory device. The memory device stores the data captured by the one or more sensors.

In still a further embodiment, the one or more sensors are operatively coupled to the display so that the data captured by the one or more sensors is capable of being displayed.

In one embodiment, ballistic parameters associated with temperature, barometric pressure, humidity, altitude and ambient light conditions are sensed by a thermometer, barometer, hygrometer, altimeter, and light meter, respectively. The digital readings sensed from each of these digital ballistic parameter instruments are also configured to be transmitted (e.g., in real time) to a processor having a ballistics computer program.

In one embodiment, the viewing optic can have an inertial navigation unit including but not limited to a 3-axis compass, a 3-axis accelerometer, and a 3-axis gyroscope. In other embodiments, the 3-axis compass, a 3-axis accelerometer, and a 3-axis gyroscope can be incorporated into the viewing optic 100/100' as individual components, with appropriate software, instead of being incorporated into the viewing optic 100/100' as an integral unit. And in still other embodiments, the gyroscope can be omitted. Further, other tilt sensors can be used in place of the accelerometer. Examples of other tilt sensors include an electrolytic liquid level tilt sensor, an optical bubble tilt sensor, a capacitive bubble tilt sensor, a pendulum mechanism, a rotary optical encoder, a rotary electro-resistive encoder, a Hall Effect device, and a ceramic capacitive tilt sensor.

In one embodiment, the viewing optic 100/100' has a processor or a computing device containing a ballistics calculator or ballistics computer program that the user can access using one or more buttons operatively connected to the ballistics calculator to determine a projectile's trajectory based on one or more factors such as projectile weight, distance to target and environmental factors (such as, for example, wind speed and wind direction).

In one embodiment, the ballistics calculator computes a ballistics solution using two variables obtained from the direction sensor: (1) direction the wind originates; and (2) direction to the target. In one embodiment, the direction to the target is captured at the same time the distance to the target is determined by the ranging system. In one embodiment, the direction to the target is computed against the captured wind direction.

In one embodiment, the processor containing a ballistics calculator program can receive one or more aspects of ballistics data including but not limited to information regarding external field conditions (for example, date, time, temperature, relative humidity, target image resolution, barometric pressure, wind speed, wind direction, hemisphere, latitude, longitude, altitude), firearm information (for example, rate and direction of barrel twist, internal barrel diameter, internal barrel caliber, and barrel length), projectile information (for example, projectile weight, projectile diameter, projectile caliber, projectile cross-sectional density, one or more projectile ballistic coefficients (as used herein, "ballistic coefficient" is as exemplified by William Davis, American Rifleman, March, 1989, incorporated herein by reference), projectile configuration, propellant type, propellant amount, propellant potential force, primer, and muzzle velocity of the cartridge), target acquisition device and reticle information (for example, type of reticle, power of magnification, first, second or fixed plane of function, distance between the target acquisition device and the barrel, the positional relation between the target acquisition device and the barrel, the range at which the telescopic gunsight was zeroed using a specific firearm and cartridge), information regarding the shooter (for example, the shooter's visual acuity, visual idiosyncrasies, heart rate and rhythm, respiratory rate, blood oxygen saturation, muscle activity, brain wave activity, and number and positional coordinates of spotters assisting the shooter), and the relation between the shooter and target (for example, the distance between the shooter and target, the speed and direction of movement of the target relative to the shooter, or shooter relative to the target (e.g., where the shooter is in a moving vehicle), and direction from true North), and the angle of the rifle barrel with respect to a line drawn perpendicularly to the force of gravity).

In an embodiment, the viewing optic 100, and particularly the ballistics calculator, has at least two user-selected modes, including but not limited to a "ballistics" mode. Ballistics calculations are extremely important to shooters at distances beyond 500 yards. At these distances, the effects of gravity, bullet characteristics, gun characteristics, temperature, barometric pressure, relative humidity, wind direction, and wind velocity have a greater impact on the overall trajectory of the bullet.

In one embodiment, the processor can also be fed wind data, temperature data and other environmental field data from a remote sensing device. In one embodiment, the remote sensing device may be wirelessly linked to the processor. The processor may determine one or more ballistic parameters from the data gathered from the range finder and an inclinometer and the remote sensing device and then calculate the required Point of Aim (POA) to Point of Impact (POI) adjustment based on these ballistic parameter(s). The processor may then transmit a data signal representative of the required or desired vertical and windage adjustment for the POA to POI adjustment to a display. As described herein, such communication of the signal between the processor and the display may be achieved by either a wire-based link or a wireless link.

In an embodiment, a viewing optic 100/100' further includes a memory device (not shown). A memory device may be internal to, so as to be contained within, the viewing optic 100/100' or external to and in communication (either wired or wireless) with the viewing optic 100/100'. In such embodiments, the memory device is operatively connected to both the direction sensor and the ballistics calculator. In embodiments, the connection with the direction sensor and/or ballistics calculator may be wired or utilize wireless communication technologies. In embodiments having a memory device, the captured wind direction data may be stored in the memory device and accessible to the ballistics calculator.

Furthermore, with the wind direction captured and stored, the user can continuously range targets and have a wind corrected ballistics solution, unless the wind direction or speed changes. However, if the wind is steady, the user only has to range a new target, which provides a simple and efficient process to obtain a wind corrected ballistics solution.

In an embodiment, a viewing optic 100/100' includes a display. The display may be integrated within the sight of the viewing optic 100/100' or visible on the exterior of the viewing optic 100/100'. In still further embodiments, the display may be a separate component from the viewing optic 100/100', such as a computer, tablet, mobile phone, television or other device, and in communication with the viewing optic 100/100'. The display is configured to show various information, including menu options and ballistics data.

In a particular embodiment, the display is configured to display the distance to a target. For example, when a viewing optic 100/100' includes laser rangefinder functionality, as described above and with particular reference to measure button 2, the ballistics computer will calculate the distance to a target. When the measure button 2 is activated (e.g., pushed), the viewing optic 100/100' will emit a laser beam which the user directs toward a desired target. The laser beam reflects off the target and back to the viewing optic 100/100'. The ballistics computer calculates the distance from the viewing optic 100/100' to the target based on the signal strength and time it took to receive the reflected beam.

In a further embodiment, the viewing optic 100/100' includes an inclinometer. In such embodiment, the display may be configured to display the elevation angle of a target.

It will be appreciated that the specific shape, arrangement and physical design of the buttons 1-5 described herein may vary, provided the buttons 1-5 are operatively connected to the onboard rangefinder system(s) to permit functionality.

In an embodiment, the viewing optic 100/100' assists a user in compensating for wind direction and velocity.

As set forth above, wind direction and velocity can have a significant effect on bullet trajectory. Additionally, barometric pressure, ambient temperature, and relative humidity also affect trajectory. While the range from the shooter to the target is often the most important factor, each of the environmental factors listed above can greatly influence trajectory. The table below illustrates the effects of changing some of these parameters by 10%.

TABLE 1

.308 Winchester, 178 gr Hornady ELD-X, G1

| | | | | | | | |
|---|---|---|---|---|---|---|---|
| Range (yds) | 1,000 | 1,100 | 1,000 | 1,000 | 1,000 | 1,000 | 1,000 |
| Wind Direction (°) | 70 | 70 | 77 | 70 | 70 | 70 | 70 |
| Wind Speed (mph) | 20 | 20 | 20 | 22 | 20 | 20 | 20 |
| Temperature (° F.) | 70 | 70 | 70 | 70 | 77 | 70 | 70 |
| Pressure (inHg) | 29.08 | 29.08 | 29.08 | 29.08 | 29.08 | 31.988 | 29.08 |
| Humidity (%) | 60 | 60 | 60 | 60 | 60 | 60 | 66 |
| Bullet Drop (in) | 359 | 467 | 358 | 359 | 356 | 383 | 359 |
| Bullet Lateral Movement (in) | 148 | 184 | 153 | 163 | 145 | 168 | 147 |
| Bullet Drop Difference (in) | NA | 108 | 1 | 0 | 3 | 24 | 0 |
| Δ Bullet Lateral Movement (in) | NA | 36 | 5 | 15 | 3 | 20 | 1 |

Indeed, Table 1 shows that changing the range to the target has the greatest influence on trajectory, followed by barometric pressure and wind speed. For example, when using a particular firearm, with a given ammunition and a consistent target at 1,000 yards, the wind direction and velocity can greatly impact the travel of the bullet even up to 80 inches or more. By way of specific example, the following values show the effect wind can have on bullet trajectory based on a user shooting at a target at 1,000 yards with a Winchester 0.308 rifle, Hornaday ELD-X 178 grain bullet, rifle zero range of 100 yards, muzzle velocity of 2,650 feet per second, 29.08 in Hg barometric pressure, 70° F. temperature and 60% relative humidity:

(1) Wind direction is 0° relative to the target, at a speed of 0 miles per hour (mph)—the bullet will drop approximately 357 inches and move to the left approximate 6 inches.

(2) Wind direction is 90° relative to the target, at a speed of 10 mph—the bullet will drop approximately 357 inches and move to the left approximately 75 inches.

(3) Wind direction is 40° relative to the target, at a speed of 10 mph—the bullet will drop approximately 359 inches and move to the left approximately 47 inches.

The above scenarios show just how much a 10 mph wind affects bullet trajectory when coming from different directions. It will be appreciated that the greater the distance to the target, the greater the effect of the wind on bullet trajectory.

Figure 3:
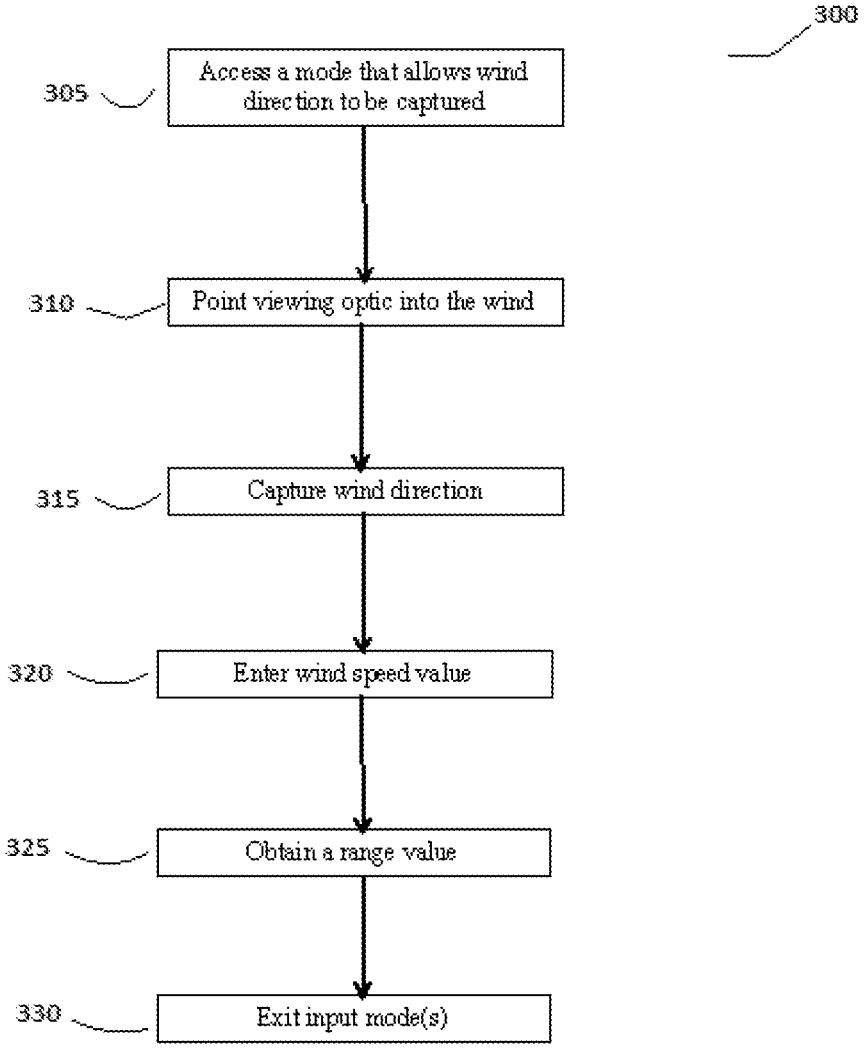
FIG. 3 illustrates an exemplary method of using a viewing optic in accordance with embodiments of the disclosure.

FIG. 3 illustrates an exemplary method 300 of inputting wind speed coming from a direction into a viewing optic in accordance with embodiments of the present disclosure.

First, a mode that allows wind direction to be captured using a direction sensor is accessed. In an embodiment, the step of accessing the mode 305 includes pressing and holding a button (or pressing a specific sequence of buttons) to enter a mode that will allow the wind direction to be captured using the direction sensor. In an embodiment, the specified button is a wind capture button 3 as described herein. In an embodiment, the step of pressing and holding the specified button 305 includes pressing and holding the specified button for a specified time, e.g., from 3 to 6 seconds, and more preferably from 3 to 5 seconds. To note, step 305 may not be necessary if the wind capture mode is already accessed.

Next, the viewing optic is pointed in the direction the wind is coming from (step 310).

Once the viewing optic is in the proper mode and pointed in the proper direction, the user presses a button to capture the wind direction (step 315). In an embodiment, the button may be the same as the specified button of step 305. In a further embodiment, the button is a wind capture button 3 as described herein. In an embodiment, the step of pressing a button to capture wind direction includes pressing and holding the button for a specified time, which is generally less than the specified time of step 305, e.g., less than 2 seconds, or more preferably less than 1 second.

In an embodiment, the step of pressing a button to capture wind direction 315 further includes automatically inputting the wind direction data to the viewing optic's onboard ballistics calculator and/or a memory device.

Step 320 is pressing a button or buttons to manipulate the wind speed value. In an embodiment, a viewing optic includes two buttons, such as the first and second selection buttons 4, 5 described above, one of which serves to allow a user to increase the wind speed value and the other to decrease the wind speed value.

Next, a range value is obtained (step 325) by activation of the ranging system. In addition, upon activation of the ranging system, the direction sensor will also capture the direction to the target. In an embodiment, the step of obtaining a range value includes aiming the viewing optic at a target and pressing a specified button to take a range. At the same time, the direction sensor determines the direction to the target.

In an embodiment, the specified button is a measure button 2 as described herein. In an embodiment, the step of pressing the specified button 325 includes pressing and holding the specified button, such as, for example, for a period of time necessary to obtain a consistent measurement. In an embodiment, Optionally, a specified button is pressed and held (or a sequence of buttons is pressed) in a final step 330 to exit the input modes. In an embodiment, the specified button is a menu button 1 as described herein. In an embodiment, the step of pressing and holding the specified button 330 includes pressing and holding the specified button 330 for a specified time, e.g., from 3 to 6 seconds, or preferably from 3 to 5 seconds. While useful to exit the ballistics calculator mode after setting each of the parameters described above, doing so is generally not required in order to use a viewing optic.

In a further embodiment, the method further includes the steps of pressing (and in some instances also holding) a specified button to enter/exit different modes to capture and/or display information obtained from additional sensors, including but not limited to, an anemometer, a barometric pressure sensor, a humidity sensor, and a temperature sensor. The steps associated with capturing and/or displaying data obtained from an anemometer, a barometric pressure sensor, a humidity sensor, and a temperature sensor can be completed either before step 305, 320, 325 or 330, or after step 330. The information captured with one or more of the sensors can be stored on a memory device.

In other embodiments, the method includes the steps of automatically capturing data from one or more sensors of an anemometer, a barometric pressure sensor, a humidity sensor, and a temperature sensor using the ballistic calculator. When the data from an anemometer, a barometric pressure sensor, a humidity sensor, and a temperature sensor is captured automatically, the data may be captured simultaneously with any of steps 305-330 or before or after any of steps 305-330.

One will appreciate that the methods and structures disclosed herein increase the accuracy and timeliness of shots even if wind direction and speed remain constant. Allowing a user to simply point the viewing optic into the direction of the wind, and having the wind information stored in a memory device, allows the ballistics calculator to reference the direction for all ranges regardless of orientation of the viewing optic.

The apparatuses and methods disclosed herein are further described by the following paragraphs:

1. A viewing optic/rangefinder comprising: a body; a direction sensor for determining the direction of wind and mounted within the body; and a processor mounted within the body and capable of controlling information for showing on the display.

2. A viewing optic/rangefinder comprising: a body; a direction sensor for determining the direction of wind and mounted within the body; and a processor mounted within the body and in communication with the direction sensor and capable of controlling information for showing on the display.

3. A viewing optic/rangefinder comprising: a body; a direction sensor for determining the direction of wind and mounted within the body; and a processor mounted within the body and in communication with the direction sensor, the processor capable of showing wind direction on the display.

4. A viewing optic/rangefinder comprising: a body, the body including a display; a ranging system for measuring a distance to a target and mounted within the body; a direction sensor for determining the direction of wind and mounted within the body; and a processor mounted within the body and capable of controlling information for showing on the display.

5. A viewing optic/rangefinder comprising: a body, the body including a display; a ranging system for measuring a distance to a target and mounted within the body; a direction sensor for determining the direction of wind and mounted within the body; and a processor mounted within the body and in communication with the ranging system, and the direction sensor and capable of controlling information for showing on the display.

6. A viewing optic/rangefinder comprising: a body, the body including a display; a ranging system for measuring a distance to a target and mounted within the body; a direction sensor for determining the direction of wind and mounted within the body; and a processor mounted within the body and in communication with the ranging system, and the direction sensor and having a ballistics calculator that uses the distance from the ranging system and the wind direction from the direction sensor to determine a ballistic trajectory that is communicated to the display.

7. A viewing optic/rangefinder comprising: a body, the body including a display; a ranging system for measuring a distance to a target and mounted within the body; a direction sensor for determining the direction of wind and mounted within the body; and a processor mounted within the body and in communication with the ranging system, and the direction sensor and having a ballistics calculator that uses the distance from the ranging system and the wind direction from the direction sensor to determine a corrected aim point.

8. The viewing optic/rangefinder of any of the preceding paragraphs further comprising a processor mounted within the body.

9. The viewing optic/rangefinder of any of the preceding paragraphs further comprising a ranging system to determine the distance to a target and mounted within the body.

10. The viewing optic/rangefinder of any of the preceding paragraphs, wherein the processor is in communication with the ranging system.

11. The viewing optic/rangefinder any of the preceding paragraphs, wherein the processor is in communication with the direction sensor.

12. The viewing optic/rangefinder any of the preceding paragraphs, wherein the processor has a ballistics computer program that uses the range from the ranging system and the wind direction from the direction sensor to determine a ballistics trajectory.

13. The viewing optic/rangefinder of any of the preceding paragraphs, further comprising a memory device to store information from the direction sensor, wherein the memory device is in communication with the direction sensor.

14. The viewing optic/rangefinder of any of the preceding paragraphs, further comprising at least one additional sensor selected from the group consisting of: an anemometer, a barometric pressure sensor, a humidity sensor, and a temperature sensor, and combinations thereof.

15. The viewing optic/rangefinder of any of the preceding paragraphs, further including a first button mounted on the body and operatively connected to the ranging system.

16. The viewing optic/rangefinder of any of the preceding paragraphs, further including a second button mounted on the body and operatively connected to the direction sensor.

17. The viewing optic/rangefinder of any of the preceding paragraphs, further including a third button to adjust wind speed after engagement of the direction sensor.

18. The viewing optic/rangefinder of any of the preceding paragraphs which is a rangefinding binocular.

19. The viewing optic/rangefinder of any of the preceding paragraphs which is a rangefinding monocular.

20. The viewing optic/rangefinder of any of the preceding paragraphs wherein the direction sensor is a compass.

21. The viewing optic/rangefinder of any of the preceding paragraphs wherein the direction sensor is a compass having a 3-axis accelerometer and a 3-axis magnetometer.

22. A method of calculating a ballistics trajectory comprising: pointing a viewing optic in a direction corresponding to a direction from which wind originates; the viewing optic having a body, a direction sensor mounted within the body, and a processor in communication with the direction sensor and having a ballistics program; capturing the wind direction by activating or communicating with the direction sensor; communicating wind direction to the processor; and using the ballistics program to determine a ballistic trajectory.

23. A method of calculating a ballistics trajectory comprising: pointing a viewing optic in a direction corresponding to a direction from which wind originates; the viewing optic having a body, a direction sensor mounted within the body, and a processor in communication with the direction sensor and having a ballistics program; capturing the wind direction by pressing a button in communication with the direction sensor; pressing one or more buttons to input wind speed; and communicating wind direction and wind speed to the processor; and using the wind direction and wind speed in the ballistics program to determine a ballistic trajectory.

24. A method of calculating a ballistics trajectory comprising: pointing a viewing optic in a direction corresponding to a direction from which wind originates; the viewing optic having a body, a direction sensor mounted within the body, a ranging system for determining distance to a target, and a processor in communication with the direction sensor and ranging system and having a ballistics program; capturing the wind direction by activating the direction sensor; inputting wind speed; determining the distance to a target by activating the ranging system; communicating wind direction, wind speed, and distance to the target to the processor; and using the wind direction, wind speed, and distance in the ballistics program to determine a ballistic trajectory.

25. A method of calculating a ballistics trajectory comprising: pointing a viewing optic in a direction corresponding to a direction from which wind originates; the viewing optic having a body, a direction sensor mounted within the body, a ranging system for determining distance to a target, and a processor in communication with the direction sensor and ranging system and having a ballistics program; capturing the wind direction by pressing a button in communication with the direction sensor; pressing one or more buttons to input wind speed; determining the distance to a target by pressing a button in communication with the ranging system; communicating wind direction, wind speed, and distance to the target to the processor; and using the wind direction, wind speed, and distance in the ballistics program to determine a ballistic trajectory.

26. A method of determining wind direction comprising: pointing a viewing optic in a direction corresponding to a direction from which wind originates; the viewing optic having a body, the body having a display, a direction sensor mounted within the body, and a processor in communication with the direction sensor; capturing the wind direction by pressing a button in communication with the direction sensor, and communicating the wind direction to the display.

27. A method of determining wind direction comprising: accessing a wind capture mode of a viewing optic, the viewing optic having a body, the body having a display, a direction sensor mounted within the body, and a processor in communication with the direction sensor; pointing the viewing optic in a direction corresponding to a direction from which wind originates; capturing the wind direction by pressing a button in communication with the direction sensor, and communicating the wind direction to the display.

28. The method of any of the preceding paragraphs, further comprising prior to pointing the viewing optic, accessing a wind direction capture mode of the viewing optic.

29. The method of any of the preceding paragraphs, further comprising prior to pointing the viewing optic, accessing a wind direction capture mode by pressing a button in communication with the direction sensor.

30. The method of any of the preceding paragraphs, further comprising inputting wind speed and communicating the wind speed to the processor.

31. The method of any of the preceding paragraphs, wherein activating the direction sensor comprises pressing/pushing/sliding a control device so that the direction sensor is active or in an on-mode.

32. The method of any of the preceding paragraphs, wherein activating the ranging system comprises pressing/pushing/sliding a control device so that the ranging system is active or in an on-mode.

33. The method of any of the preceding paragraphs, further inputting wind speed by pressing one or more buttons or control devices.

34. The method of any of the preceding paragraphs, further including storing the wind direction on a memory device.

35. The method of any of the preceding paragraphs, further comprising obtaining a range value by aiming the viewing optic at a target and activating the ranging system.

36. The method of any of the preceding paragraphs, further comprising obtaining a range value by aiming the viewing optic at a target and pressing a specified button in communication with the ranging system.

37. The method of any of the preceding paragraphs, further comprising the steps of capturing information from one or more sensors of the viewing optic, the sensors selected from the group consisting of an anemometer, a barometric pressure sensor, a humidity sensor, and a temperature sensor.

38. The viewing optic/rangefinder of any of the preceding paragraphs, wherein the direction sensor also determine the direction of a target.

39. The viewing optic/rangefinder of any of the preceding paragraphs, wherein the direction sensor also determine the direction of a target upon activation of a ranging system.

40. The viewing optic/rangefinder of any of the preceding paragraphs, wherein the ballistics computer program further uses the direction of a target upon from the direction sensor to determine a ballistic trajectory.

41. The viewing optic/rangefinder of any of the preceding paragraphs, wherein a single direction sensor determine the direction from which the wind originates and the direction of a target.

42. The rangefinder of any of the preceding paragraphs, wherein the rangefinder does not have a display.

43. The rangefinder of any of the preceding paragraphs, wherein the rangefinder communicates with a second device having a display.

While multiple embodiments of a viewing optic/rangefinder have been described in detail herein, it should be apparent that modifications and variations thereto are possible, all of which fall within the true spirit and scope of the invention. With respect to the above description then, it is to be realized that the optimum dimensional relationships for the parts of the viewing optics of this disclosure, to include variations in size, materials, shape, form, function and manner of operation, assembly and use, are deemed readily apparent and obvious to one of skill in the art, and all equivalent relationships to those illustrated in the drawings and described in the specification are intended to be encompassed by embodiments of the present disclosure. Further, since numerous modifications and changes will readily occur to those skilled in the art, it is not desired to limit the invention to the exact construction and operation shown and described, and accordingly, all suitable modifications and equivalents may be resorted to, falling within the scope of this disclosure.

What is claimed is:

1. A viewing optic comprising:

a body, the body including a display;

a ranging system for measuring a distance to a target and mounted within the body;

a direction sensor mounted within the body for determining direction of wind and direction of the target, wherein the direction sensor determines the direction of the wind by pointing the viewing optic in the direction corresponding to a direction from which the wind originates, and wherein the direction sensor determines the direction of the target by pointing the viewing optic at the target; and a processor mounted within the body and capable of controlling information for showing on the display, wherein the direction sensor is configured to communicate a determined wind direction to the processor.

2. The viewing optic of claim 1, wherein the processor is in communication with the ranging system.

3. The viewing optic of claim 2, wherein the processor is in communication with the direction sensor.

4. The viewing optic of claim 3, wherein the processor has a ballistics computer program that uses the distance from the ranging system and the wind direction from the direction sensor to determine a ballistic trajectory.

5. The viewing optic of claim 1, further comprising a memory device to store information from the direction sensor, wherein the memory device is in communication with the direction sensor.

6. The viewing optic of claim 1, further comprising at least one additional sensor selected from the group consisting of: an anemometer, a barometric pressure sensor, a humidity sensor, and a temperature sensor, and combinations thereof.

7. The viewing optic of claim 1, further including a first button mounted on the body and operatively connected to the ranging system.

8. The viewing optic of claim 1, further including a second button mounted on the body and operatively connected to the direction sensor.

9. The viewing optic of claim 1, further including a third button to adjust wind speed after engagement of the direction sensor.

10. The viewing optic of claim 1, which is a rangefinding binocular.

11. The viewing optic of claim 1, which is a rangefinding monocular.

12. A rangefinder comprising:

a body;

a ranging system for measuring the distance to a target and mounted within the body, a direction sensor mounted within the body for determining direction of wind and direction of the target, wherein the direction sensor determines the direction of the wind by pointing the rangefinder in the direction corresponding to a direction from which the wind originates, and wherein the direction sensor determines the direction of the target by pointing the rangefinder at the target;

a processor mounted within the body and in communication with the ranging system and the direction sensor, wherein the direction sensor is configured to communicate a determined wind direction to the processor and the processor has a ballistics computer program that uses the distance from the ranging system, the determined wind direction and the direction of the target from the direction sensor to determine a ballistic trajectory.

13. The rangefinder of claim 12, further comprising a memory device to store information from the direction sensor, wherein the memory device is in communication with the direction sensor.

14. The rangefinder of claim 12, further comprising at least one additional sensor selected from the group consisting of: an anemometer, a barometric pressure sensor, a humidity sensor, and a temperature sensor, and combinations thereof.

15. The rangefinder of claim 12, wherein the direction sensor determines the direction of the wind without manual input from the user.

16. A method of calculating a ballistic trajectory comprising:

pointing a viewing optic in a direction corresponding to a direction from which wind originates; the viewing optic having a body, a direction sensor mounted within the body, and a processor in communication with the direction sensor and having a ballistics program;

capturing the wind direction by activating the direction sensor while the viewing optic is pointed in the direction corresponding to a direction from which wind originates;

communicating, using the direction sensor, the wind direction the processor; and using the ballistics program to determine a ballistic trajectory.

17. The method of claim 16, further comprising prior to pointing the viewing optic, accessing a wind direction capture mode of the viewing optic.

18. The method of claim 16, further including storing the wind direction on a memory device.

19. The method of claim 16, further comprising obtaining a range value by aiming the viewing optic at a target and activating a ranging system of the viewing optic.

20. The method of claim 16, further comprising the steps of capturing information from one or more sensors of the viewing optic, the sensors selected from the group consisting of an anemometer, a barometric pressures sensor, a humidity sensor, and a temperature sensor.

* * * * *